United States Patent [19]

Hirakawa et al.

[11] 4,028,211

[45] June 7, 1977

[54] APPARATUS FOR AUTOMATICALLY REPLACING ELECTRODES USED FOR ELECTROLYTIC REFINING OF METAL

[75] Inventors: Seishiro Hirakawa; Shyuji Kanai; Matsuo Ikeda; Toshinori Hirata, all of Gifu, Japan

[73] Assignee: Mitsui Mining & Smelting Co., Ltd., Tokyo, Japan

[22] Filed: May 17, 1976

[21] Appl. No.: 686,747

[30] Foreign Application Priority Data

Feb. 10, 1976 Japan ..... 51-13404

[52] U.S. Cl. ..... 204/267; 204/198; 204/225; 204/271; 204/279

[51] Int. Cl.[2] ..... C25C 1/12; C25C 1/18; C25C 7/00; C25C 7/06

[58] Field of Search ..... 204/252, 253, 254, 262, 204/263, 264, 266, 267, 268, 270, 271, 277, 279, 286, 198, 225

[56] References Cited

UNITED STATES PATENTS

| | | | |
|---|---|---|---|
| 1,464,689 | 8/1923 | Allan | 204/254 |
| 3,236,760 | 2/1966 | Messner | 204/254 X |
| 3,749,661 | 7/1973 | Cook et al. | 204/279 X |

*Primary Examiner*—Arthur C. Prescott

[57] ABSTRACT

An apparatus for automatically replacing anodes and cathodes disposed alternately in an electrolytic cell used for the electrolytic refining of a metal. The anodes are each formed with a pair of recesses on opposite edges of the upper end thereof, and a central cutout having a sufficient depth is formed between the recesses of the anodes. The apparatus comprises a pair of parallel rods engageable with the recesses of all the anodes and a plurality of clamping units adapted for clamping the cathodes on opposite sides of the upper end without engaging the anodes during clamping movement by virtue of the provision of the cutout in the anodes. Thus, the anodes and cathodes can be automatically loaded into and unloaded from the electrolytic cell while maintaining the predetermined inter-electrode distance required for the electrolysis of the metal.

8 Claims, 17 Drawing Figures

APPARATUS FOR AUTOMATICALLY REPLACING ELECTRODES USED FOR ELECTROLYTIC REFINING OF METAL

BACKGROUND OF THE INVENTION

This invention relates to an apparatus adapted for automatic handling of electrodes in electrolytic cells used for the electrolytic refining of metals in an electrolytic metal production plant.

In the electrolytic refining of a metal such as lead or copper, anodes of crude metal and cathodes of pure metal used for depositing of the desired metal are alternately disposed in electrolytic cells containing an aqueous solution of a salt of the desired metal. These anodes and cathodes are arranged in such a relationship that a predetermined inter-electrode distance is always maintained therebetween. These electrodes are replaced by fresh ones after the electrolysis is carried out over a predetermined period of time, and such electrode replacement is repeated to obtain the desired electrodeposited metal.

The replacement of these electrodes has heretofore been resorted to means such as an overhead travelling crane having a span equal to the span of the cell room or a hoist suspended from the ceiling structure of the cell room. It has therefore been necessary to accurately position the crane or hoist for travelling movement, traversing movement, turning movement, rolling movement and vertical movement. It has further been necessary to make manual fine adjustment of such relative positions due to the fact that these relative positions are variable depending the individual electrolytic cells resulting in impossibility of automation of this position adjustment.

The electrodes are generally disposed in the electrolytic cells in such limited condition that they are relatively slightly spaced from each other, and these electrodes must often be simultaneously handled. Especially, in the case of the electrolytic refining of a metal such as lead or copper, it is frequently required to handle both the anodes and the cathodes simultaneously for replacement by fresh one. The clamping means of the conventional crane or hoist has not been sufficiently suitable for the simultaneous handling of the electrodes, and efficient and useful means capable of automatically simultaneously handling the electrodes has been demanded.

SUMMARY OF THE INVENTION

It is an object of the present invention to provide a novel and useful apparatus which is capable of automatically loading the electrodes into any desired electrolytic cell and automatically unloading the electrodes from any desired electrolytic cell without the aid of human hands.

Another object of the present invention is to provide an apparatus of the kind above described which can place the required electrodes in any desired electrolytic cell by a single loading operation in such a relationship that the electrodes are spaced apart by a predetermined inter-electrode distance from each other without engaging with each other or at least without extremely approaching toward each other Still another object of the present invention is to provide an apparatus of the kind above described which can not only load or unload both the anodes and the cathodes into or from any desired electrolytic cell by a single loading or unloading operation but also can selectively handle or lift all the anodes or all the cathodes only by a single unloading operation.

Yet another object of the present invention is to provide an apparatus of the kind above described in which a unique electrode handling device is provided which can determine the exact relative positions of the electrodes in any desired electrolytic cell when it is merely stopped at the position above predetermind electrolytic cell.

A further object of the present invention is to provide an apparatus of the kind above described in which approximate switches are provided for detecting the exact stopping position of the electrode handling device and are supported by a support member of material other than a ferromagnetic material, so that the stopping position of the electrode handling device can be precisely detected without being affected by the current of large value supplied for the electrolysis.

DETAILED DESCRIPTION OF THE INVENTION

A preferred embodiment of the automatic electrode replacing apparatus according to the present invention will be described with reference to an application to a plant used for the electrolytic refining of lead.

Figure 1:
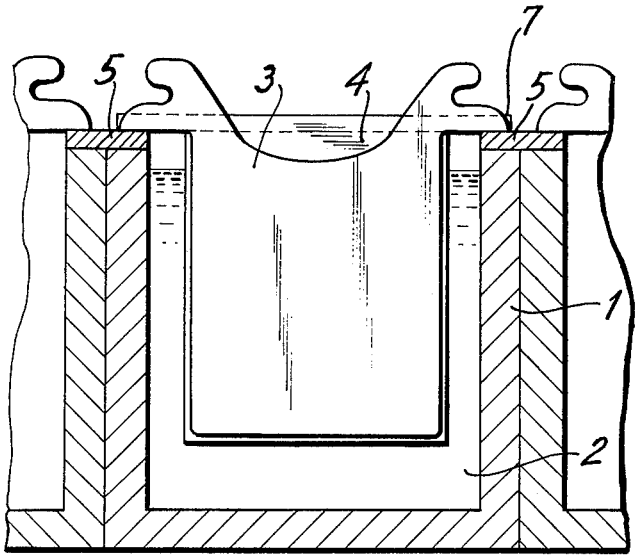
FIG. 1 is a vertical sectional view of an electrolytic cell, the section being taken along the line A—A in FIG. 4.
Figure 2:
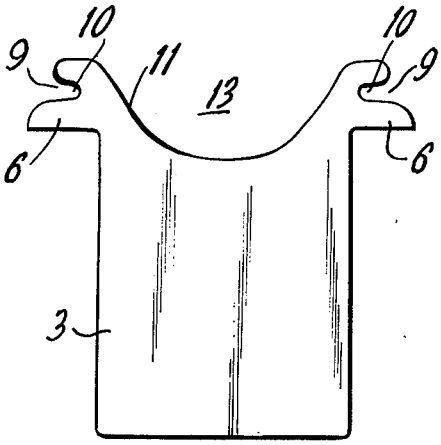
FIG. 2 is a side elevational view of the anode shown in FIG. 1.
Figure 3:
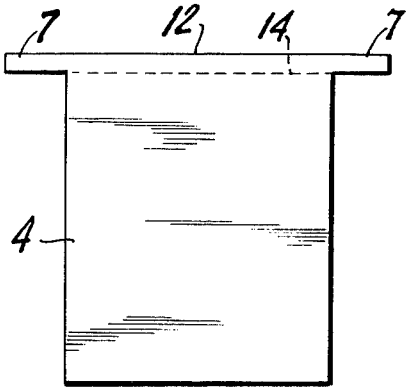
FIG. 3 is a side elevational view of the cathode shown in FIG. 1.
Figure 5:
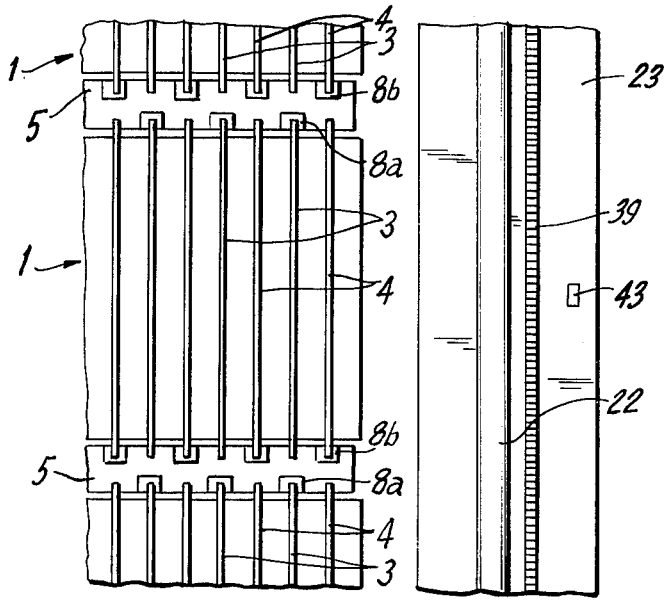
FIG. 5 is an enlarged plan view of the part B in FIG. 4.
Figure 6:
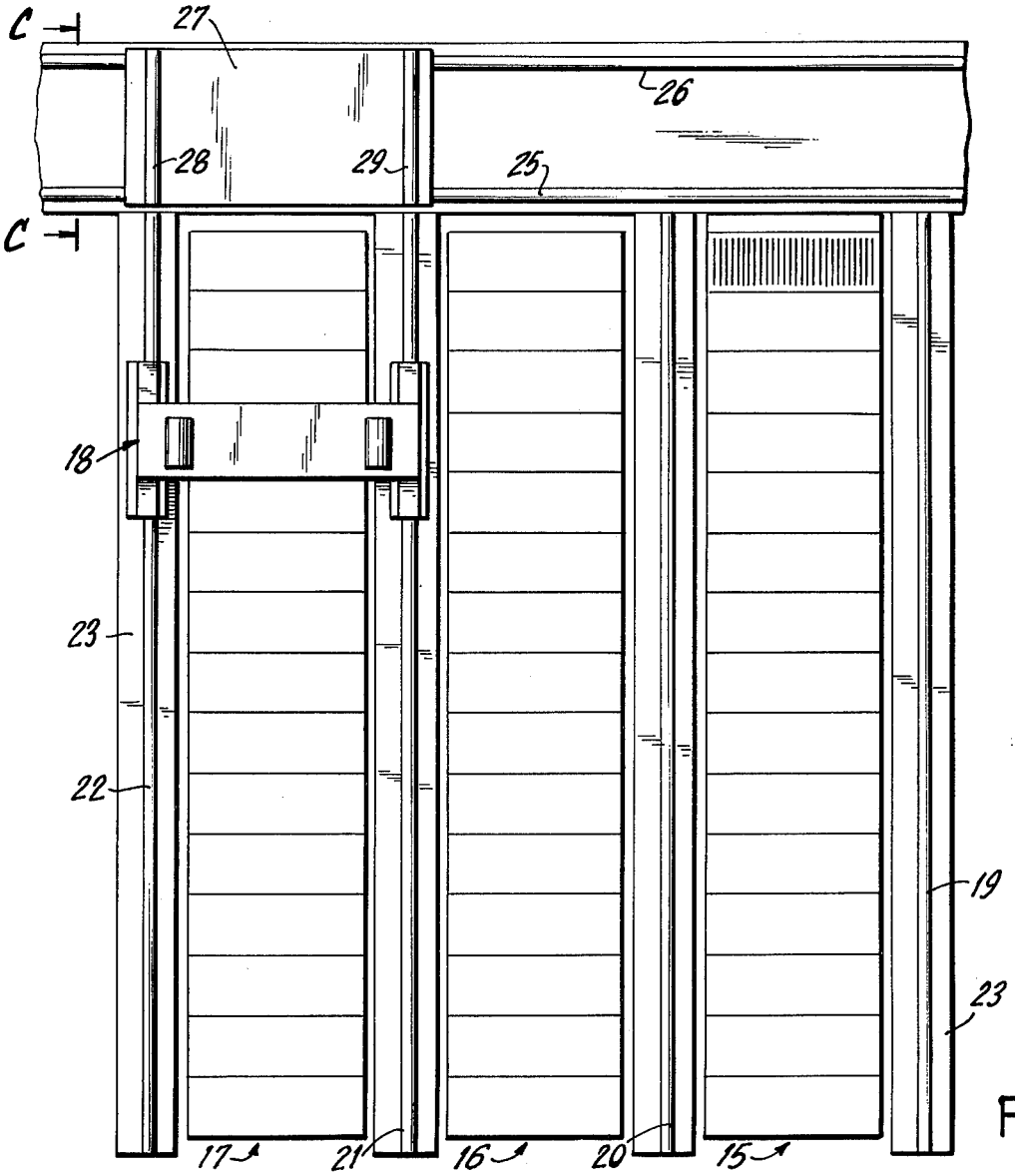
FIG. 6 is a plan view of FIG. 4.

Referring to FIG. 1, an electrolyte 2 is filled in an electrolytic cell 1, and 43 anodes 3 and 44 cathodes 4 used for the electrolytic refining of lead are alternately arranged in the electrolytic cell 1 while maintaining an inter-electrode distance 1 of 55 mm therebetween. As shown in FIGS. 1 to 3, the anodes 3 and cathodes 4 disposed alternately in the electrolytic cell 1 are respectively provided with a pair of shoulders 6 and a pair of shoulders 7 sitting on a pair of contact bars 5 of electrical conductor fixed to the upper end of the front and rear walls of the electrolytic cell 1. These shoulders 6 and 7 cooperate with the contact bars 5 for holding the alternate anodes 3 and cathodes 4 in the electrolytic cell 1 while maintaining the predetermined inter-electrode distance 1 therebetween. Current is supplied to the anodes 3 and cathodes 4 through the contact bars 5 engaged by the shoulders 6 and 7. strips 8*a* and 8*b* of electrical insulator are mounted to the contact bars 5 to electrically insulate the associated shoulders 6 and 7 of the anodes 3 and cathodes 4 as shown in FIG. 5, and the remaining shoulders 6 and 7 are in direct engagement with the contact bars 5 so that the current can be supplied to the anodes 3 and cathodes 4 through the portions of the contact bars 5 engaged directly by the shoulders 6 and 7.

As shown in FIG. 2, each anode 3 is provided with a pair of outwardly directed openings 9 forming a pair of horizontal recesses 10 above the respective shoulders 6 at opposite edge portions of the upper end. Further, a central recess 13 is formed in the middle of the upper end of each anode 3, and the bottom level of this recess 13 is lower than the level of the upper end 12 of the adjacent electrodes or cathodes 4. In the form shown in FIG. 2, the anode 3 has a uniform thickness of about 25 mm throughout. As shown in FIG. 3, the cathode 4 is formed by covering a crossbar 14 about 24 mm wide and 42 mm high with a sheet of lead having a thickness less than 1 mm. Therefore, the opposite ends of the crossbar 14 provide the shoulders 7 of the cathode 4.

Figure 4:
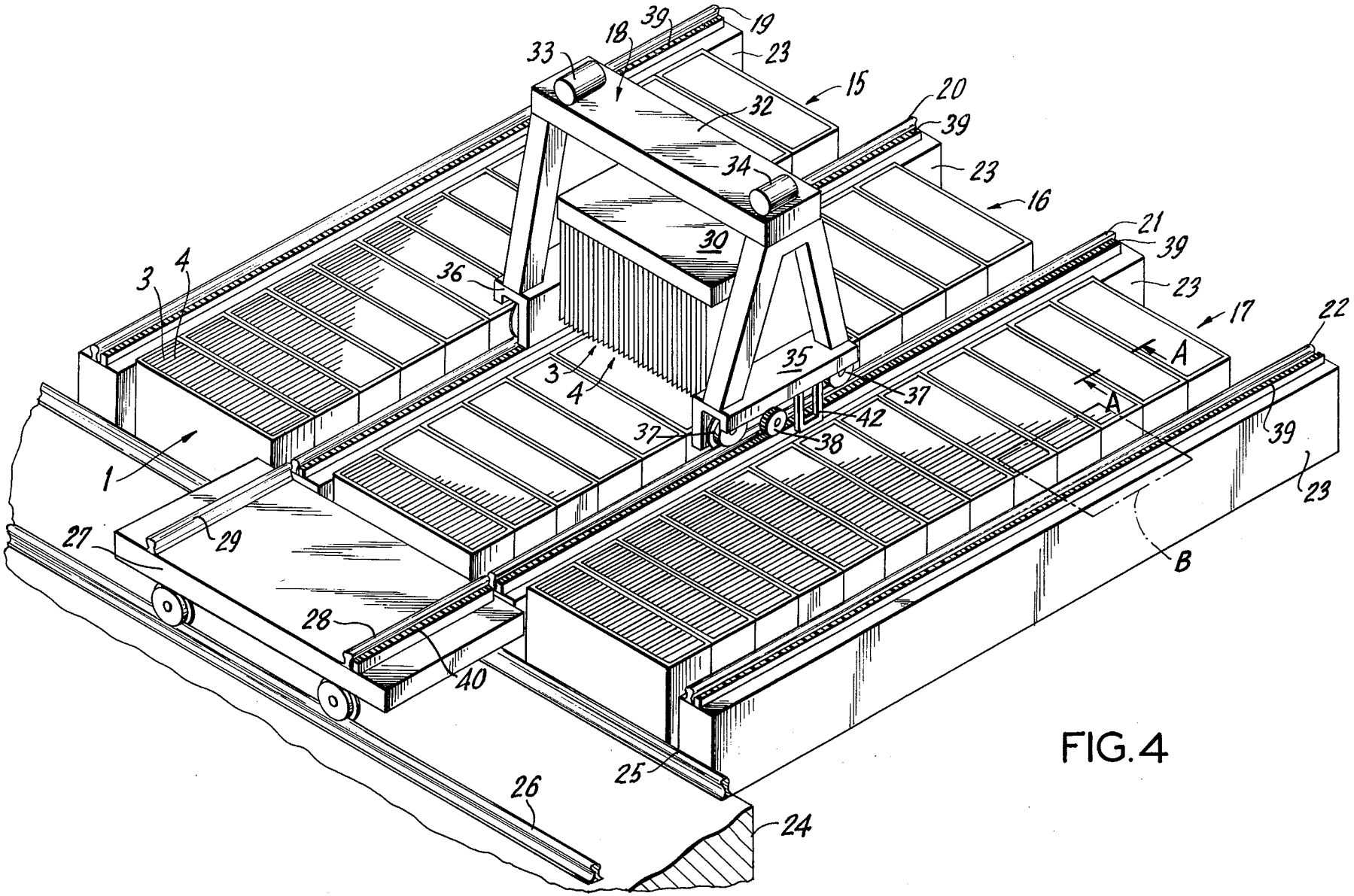
FIG. 4 is a general perspective view of an embodiment of the apparatus according to the present invention when applied to an electrolytic lead production plant.

Referring to FIG. 4, a plurality of electrode cell groups 15, 16 and 17 are arranged in parallel, and in each electrode cell group, a plurality of electrolytic cells 1 as shown in FIG. 1 are arranged in series. A plurality of rails 19, 20, 21 and 22 extend in parallel with the electrolytic cell groups 15, 16 and 17 in equally spaced apart relation. These rails 19, 20, 21 and 22 are fixed to support blocks 23 disposed between the electrolytic cell groups 15 and 16, between the electrolytic cell groups 16 and 17, and external to the electrolytic cell groups 15 and 17. The contact bars 5 of conductor shown in FIG. 1 and the strips 8*a* and 8*b* of insulator shown in FIG. 5 are positioned so that these elements have the same relative vertical and horizontal positions to those of the rail surface. An electrode handling device 18 is shown located on the rails 20 and 21 for loading or unloading the anodes 3 and cathodes 4 into or from the electrolytic cells 1.

A pair of rails 25 and 26 are laid on a support block 24 to extend normal to the extending direction of the rails 19, 20, 21 and 22, and a traversing truck 27 is adapted to travel on the rails 25 and 26 in a direction normal to the longitudinal direction of the electrolytic cell groups 15, 16 and 17. A pair of auxiliary rails 28 and 29 are disposed on the truck 27 and are spaced from each other by a distance equal to that of the adjacent ones of the four rails 19, 20, 21 and 22. Thus, the electrode handling device 18 adapted to travel over the electrolytic cells 1 by running on the adjacent ones of the rails 19, 20, 21 and 22 can be transferred onto the traversing truck 27, and then the truck 27 is moved to the position opposite to any desired one of the electrolytic cell groups 15, 16 and 17, so that the electrode handling device 18 can travel on the rails in the longitudinal direction of the desired electrolytic cell group. It will therefore be seen that the anodes 3 and cathodes 4 in all the electrolytic cells 1 can be handled as desired by the single electrode handling device 18 by moving the device 18 along the two rails in the longitudinal direction of anyone of the electrolytic cell groups 15, 16 and 17 and then transferring the device 18 onto the truck 27 for bringing the device 18 to the position ready to move over another electrolytic cell group.

Figure 7:
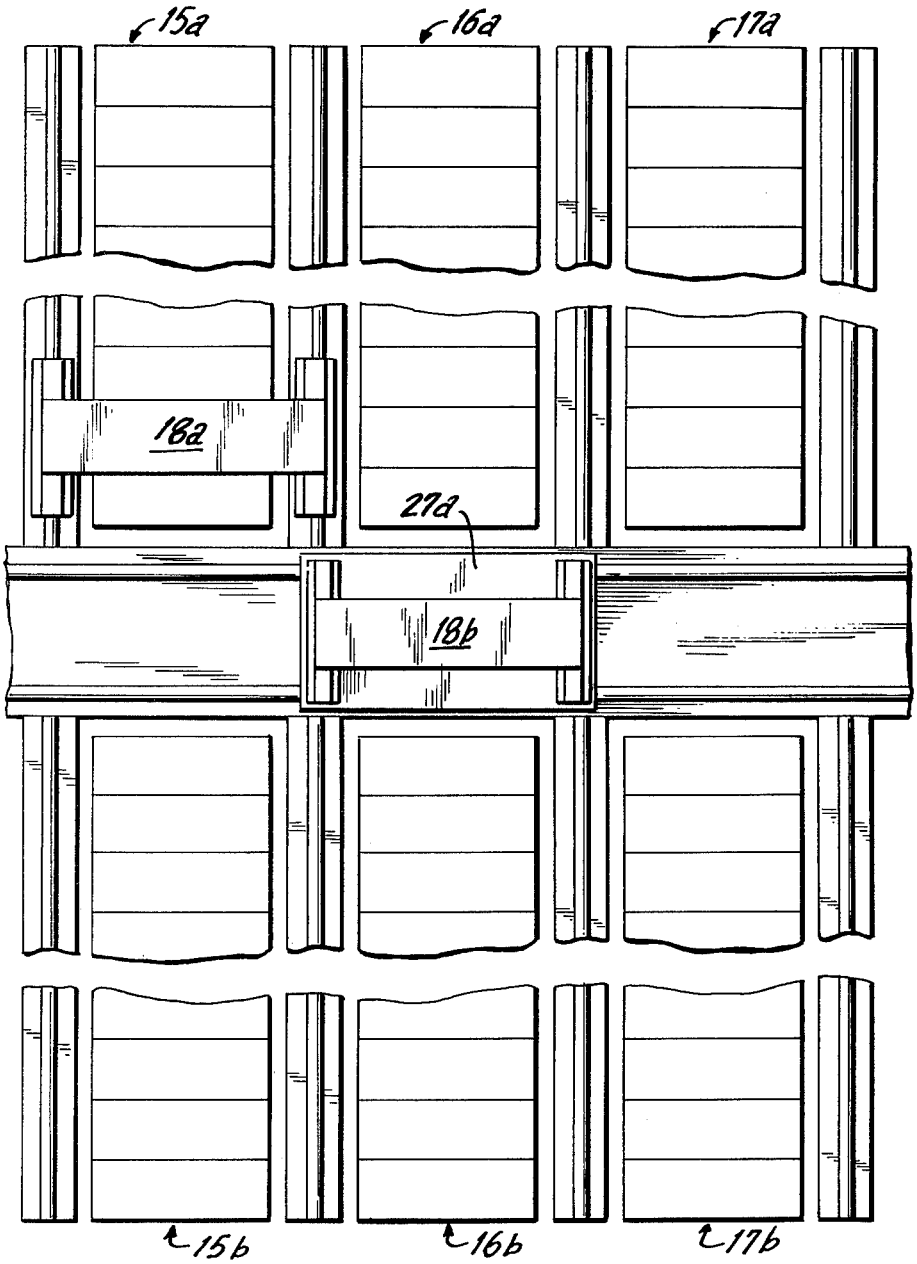
FIG. 7 is a plan view of another embodiment of the present invention.
Figure 8:
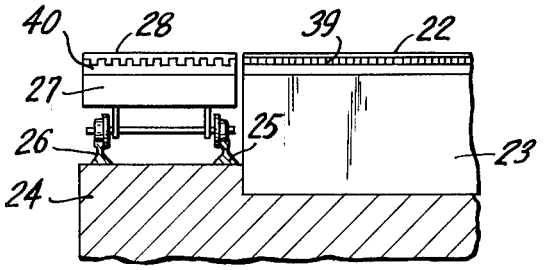
FIG. 8 is a vertical sectional view taken along the line C—C in FIG. 6.

FIG. 7 shows another embodiment of the present invention. Referring to FIG. 7, two electrode handling devices 18*a* and 18*b* are provided for handling the anodes 3 and cathodes 4 in electrolytic cells of six electrolytic cell groups 15*a*, 15*b*, 16*a*, 16*b*, 17*a* and 17*b*. A single traversing truck 27*a* is provided to transfer the electrode handling devices 18*a* and 18*b* to any desired electrode handling position.

Figure 9A:
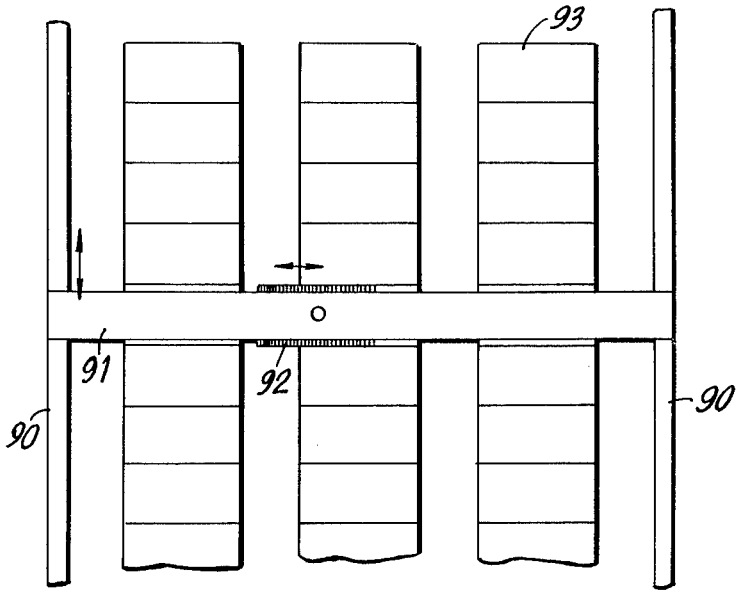
FIG. 9a (PRIOR ART)
FIGS. 9A and 9B are plan views showing an arrangement and operation of a prior art electrode handling device used for handing the electrodes in electrolytic cells.
Figure 9B:
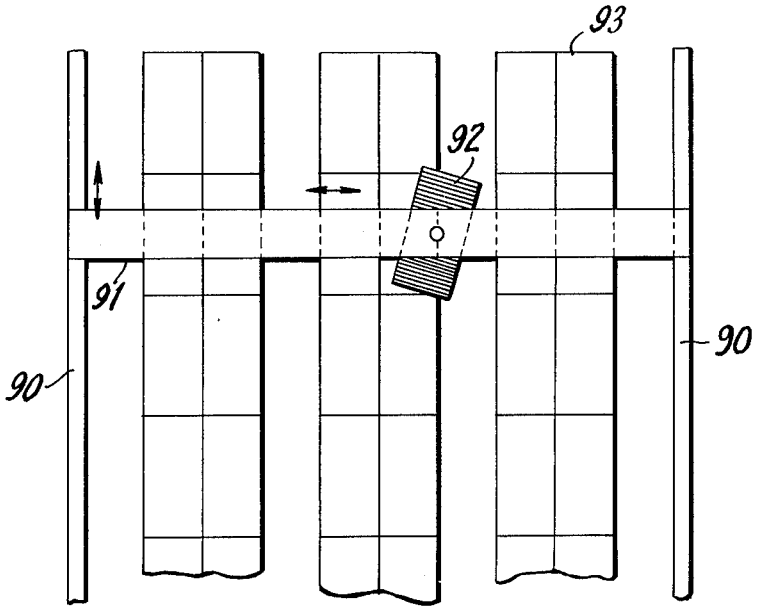
FIG. 9b (PRIOR ART)

A prior art apparatus using a crane is shown in FIGS. 9A and 9B. Referring to FIGS. 9A and 9B, an overhead travelling crane 91 is adapted to travel on rails 90, and a carrier 92 is suspended from the crane 91 for clamping the electrodes in a desired one of electrolytic cells 93. In such a prior art apparatus, the position of the carrier 92 relative to the electrolytic cells 93 must be precisely determined for all the directions including the travelling direction, traversing direction and turning direction. In contradistinction, in the present invention it is merely necessary to position the electrode handling device 18 for the travelling direction as will be readily apparent from FIGS. 4 to 7, and thus, the electrodes can be automatically handled without the aid of human hands.

Figure 10:
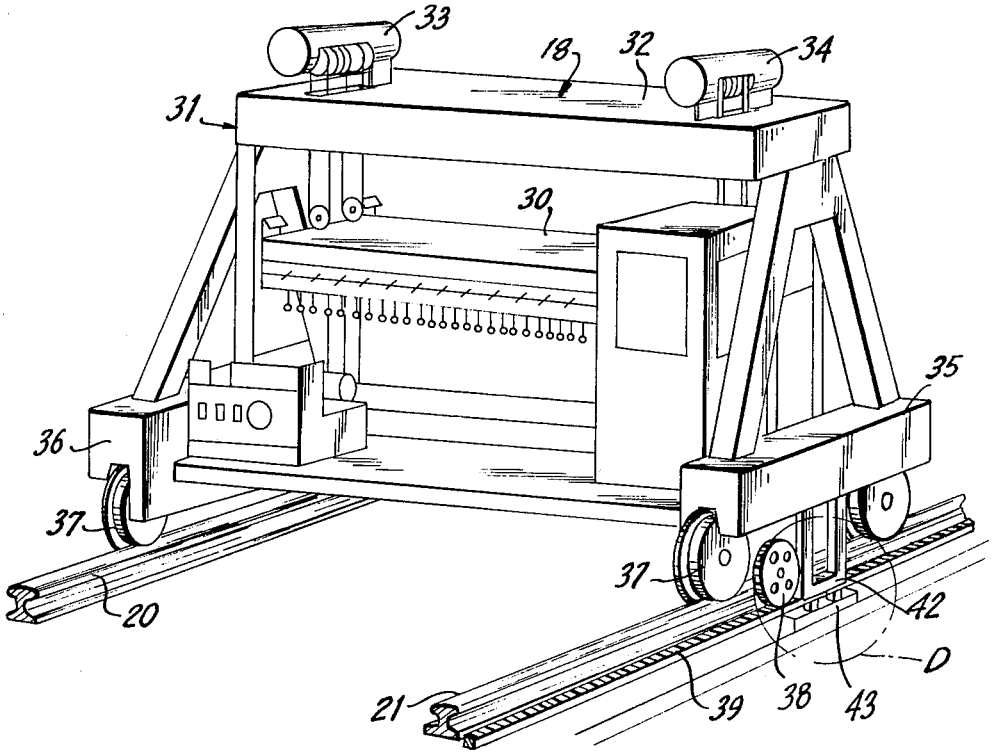
FIG. 10 is an enlarged perspective view of the electrode handling device shown in FIG. 4.
Figure 13:
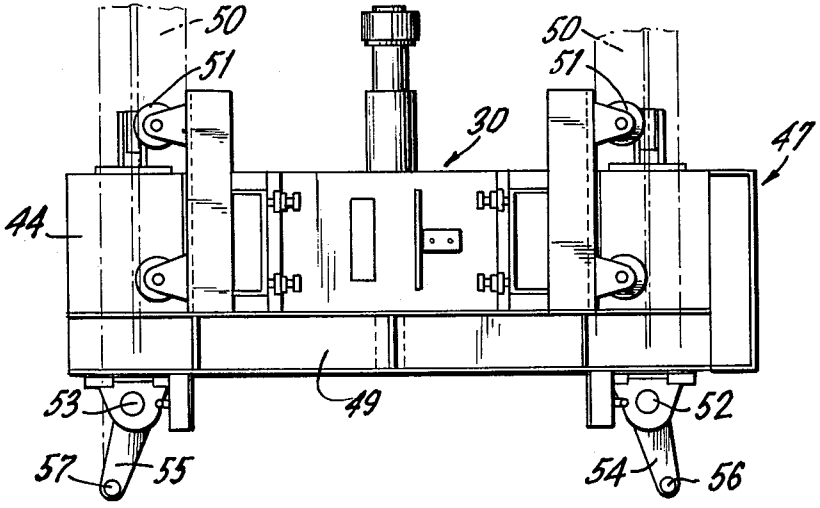
FIG. 13 is a side elevational view of the carrier when viewed along the line E—E in FIG. 12.

Referring to FIG. 10, the electrode handling device 18 comprises an electrode carrier 30 which is suspended from a frame structure 31 and is vertically driven by a pair of drive motors 33 and 34 mounted on the top frame 32 of the frame structure 31. Referring to FIG. 13, guide rails 50 are fixed to the frame structure 31 and are engaged by guide rollers 51 provided on the electrode carrier 30 thereby ensuring oscillation-free vertical movement of the electrode carrier 30. Referring to FIG. 10 again, rail-engaging wheels 37 are mounted to opposite skirt portions 35 and 36 of the electrode handling device 18, and a pinion 38 is mounted to one of the skirt portions, for example, the skirt portion 35 and is connected to a drive source (not shown) mounted on the electrode handling device 18, so as to drive the electrode handling device 18 along the rails. This pinion 38 meshes with a rack 39 extending along each of the rails 19 to 22. The traversing truck 27 is also provided with a rack 40 along the auxiliary rail 28 for meshing with the pinion 38.

Figure 11:
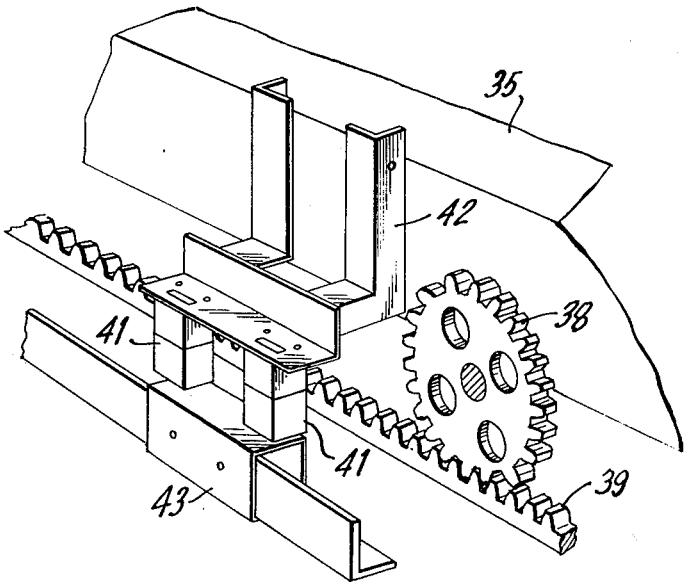
FIG. 11 is an enlarged perspective view of the part D in FIG. 10.

Referring to FIG. 11, a pair of approximate switches 41 are supported by a support bracket 42 fixed to the skirt portion 35 of the electrode handling device 18 for detecting anyone of predetermined stopping positions along the travelling direction of the electrode handling device 18 so as to precisely stop the device 18 at a selected stopping position. A detected element 43 is provided at a position corresponding to each of the electrolytic cells 1 to be detected by the approximate switches 41 thereby decelerating the electrode handling device 18 so as to stop the same at such predetermined position. The support bracket 42 is made of a material other than ferromagnetic materials in order that the position detecting function of the approximate switches 41 may not be adversely affected by the magnetic field produced by the current of large value supplied to the electrodes for the electrolysis.

Figure 12:
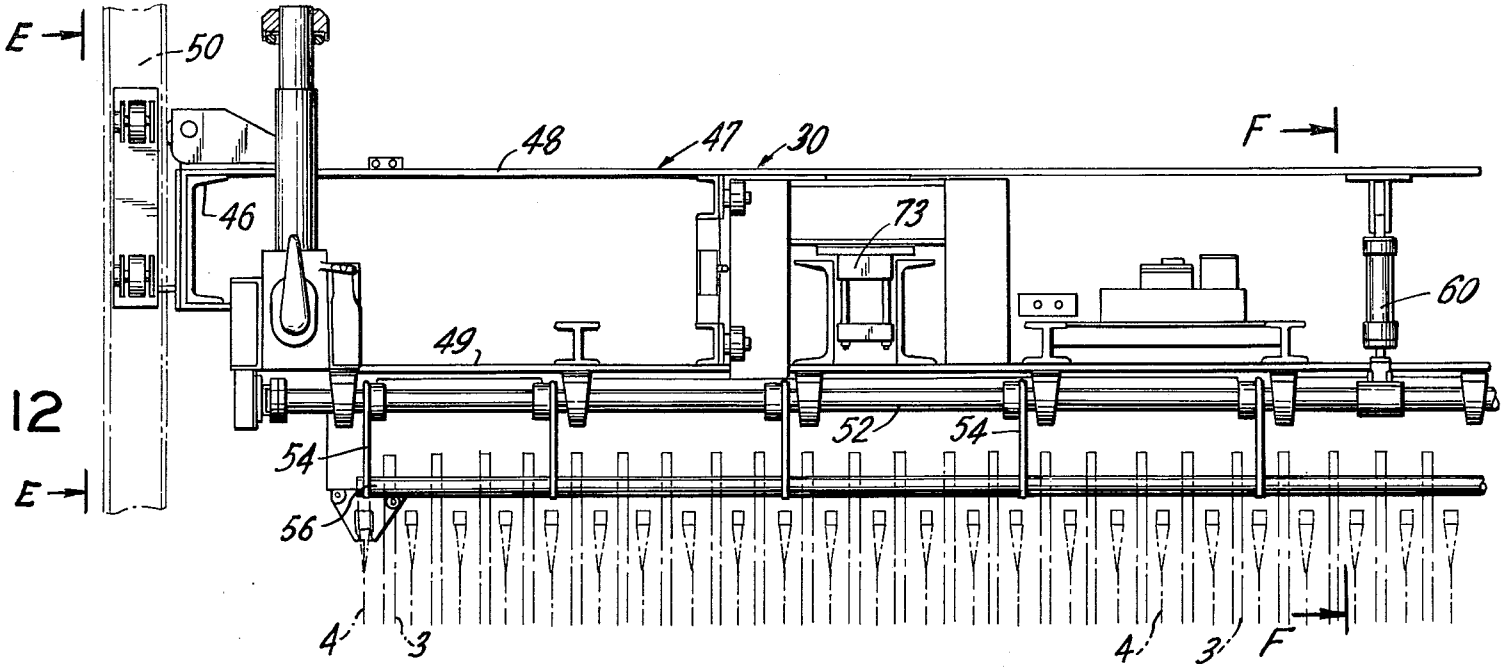
FIG. 12 is an enlarged front elevational view of the vertically movable electrode carrier in the electrode handling device shown in FIG. 10.
Figure 14:
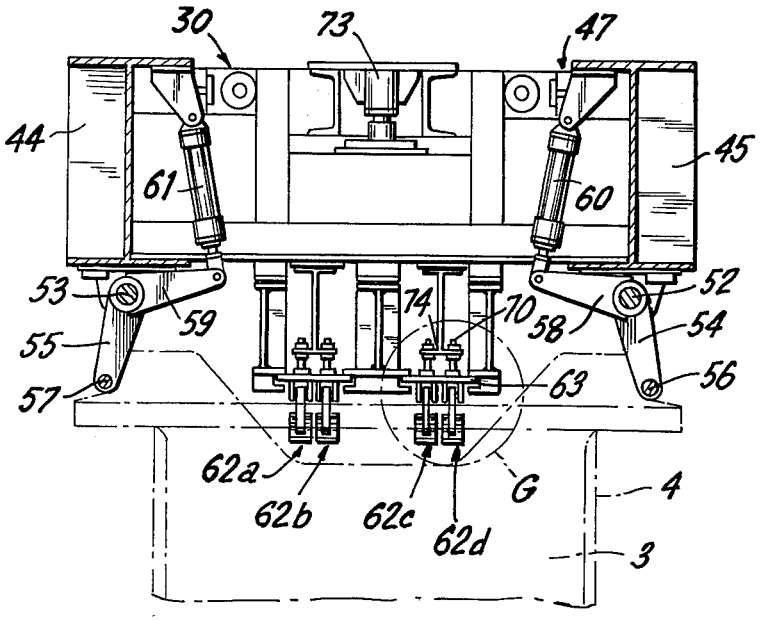
FIG. 14 is a side elevational view of the carrier when viewed along the line F—F in FIG. 12.

Referring to FIGS. 12 to 14, the electrode carrier 30 comprises a frame structure 47 composed of a plurality of angle bars 44 and 45 providing the front and rear walls respectively, angle bars 46 providing the side walls, and a plurality of vertically spaced angle bars 48 and 49 providing the top and bottom walls respectively. A pair of horizontally spaced drive shafts 52 and 53 are mounted to the lower part of the angle bars 45 and 44 respectively to extend in parallel with each other, and a plurality of pairs of follower links 54 and 55 are fixed at one end thereof to spaced positions of the drive shafts 52 and 53 respectively. A pair of horizontally parallel anode clamping rods 56 and 57 extend trhough the other end of the follower links 54 and 55 respectively. As best shown in FIG. 14, a pair of driving links 58 and 59 are fixed at one end thereof to the respective shafts 52 and 53 and are connected at the other end thereof to respective hydraulic cylinders 60 and 61, so that the anode clamping rods 56 and 57 can be urged toward and away from each other to disengageably engage the recesses 10 of all the anodes 3 at the same time. Therefore, when the two hydraulic cylinders 60 and 61 are actuated simultaneously, the anode clamping rods 56 and 57 are urged toward each other to the clamping position at which they engage the recesses 10 of all the anodes 3. Then, when the electrode carrier 30 is raised, all the anodes 3 can be lifted from within the electrolytic cell 1.

Figure 15:
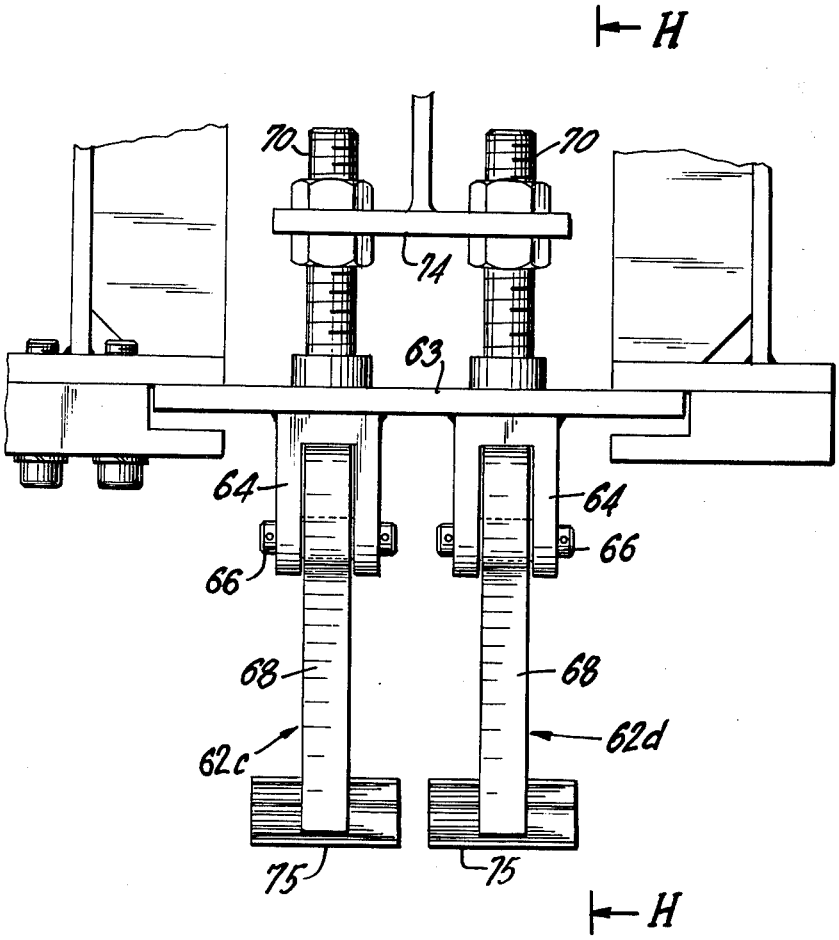
FIG. 15 is an enlarged front elevational view of the part G in FIG. 14.
Figure 16:
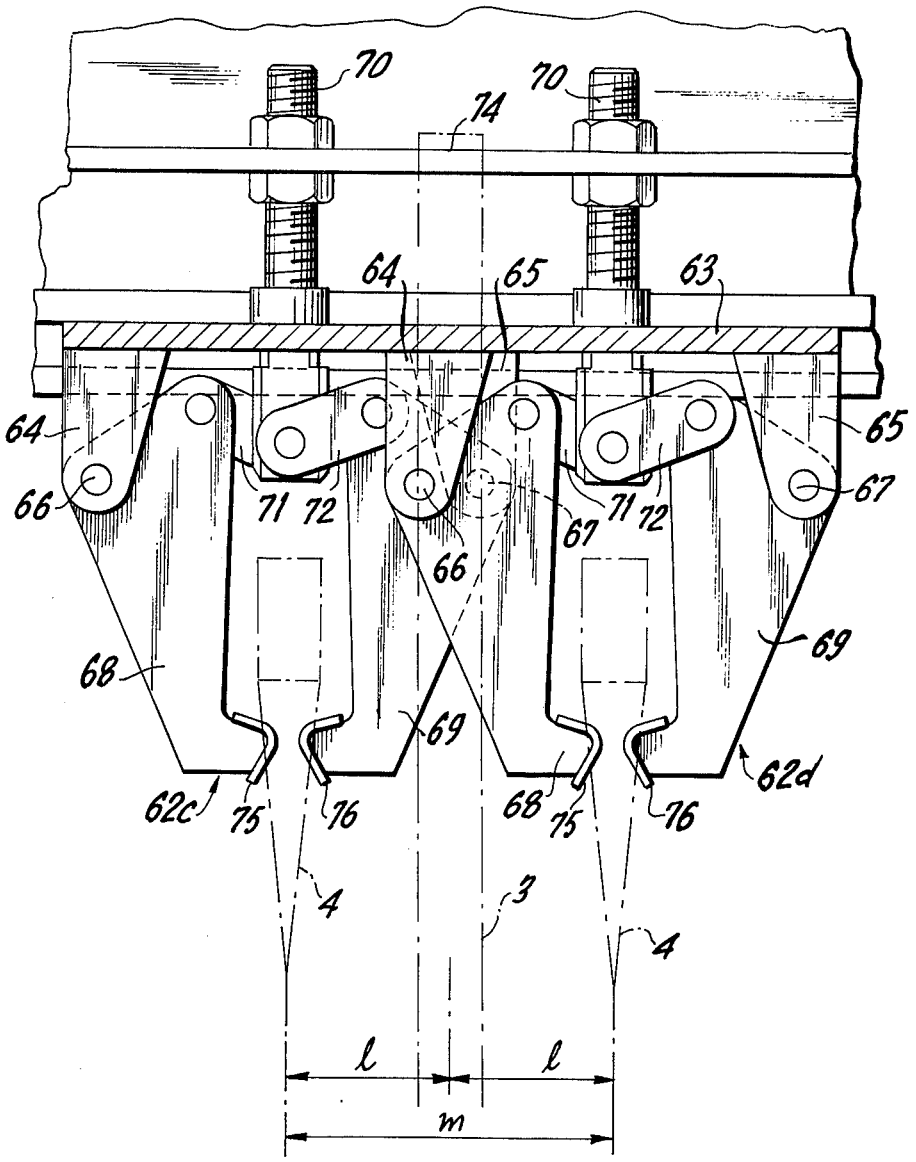
FIG. 16 is a vertical sectional view taken along the line H—H in FIG. 15.

A plurality of cathode clamping units are mounted to the lower central portion of the electrode carrier 30 as shown in FIGS. 12 to 16. Four of these cathode clamping units are shown in FIG. 14 and designated by the reference numerals 62*a*, 62*b*, 62*c* and 62*d*. Referring to FIG. 16 showing the structure of the cathode clamping units 62*c* and 62*d* in detail, two pairs of brackets 64 and 65 are fixed to a base 63, and a pair of clamping members 68 and 69 are pivoted by pins 66 and 67 to each pair of brackets 64 and 65. A rod 70 is connected to the clamping members 68 and 69 in each pair through links 71 and 72 to cause tilting movement of the clamping members 68 and 69 around the respective pins 66 and 67. These rods 70 are connected by a connecting member 74 to a hydraulic cylinder 73 so that the rods 70 can be vertically moved by the hydraulic cylinder 73 thereby swinging the clamping members 68 and 69 toward and away from each other. In the position shown in FIG. 16, the clamping members 68 and 69 are tilted toward each other to clamp the cathodes 4 at the area beneath the upper end of the crossbars 14 by cathode-engaging pawls 75 and 76 provided at the confronting end edges of the clamping members 68 and 69. Therefore, when the electrode carrier 30 is raised in the state shown in FIG. 16, all the cathodes 4 can be lifted from within the electrolytic cell 1. When the rods 70 are lowered from the position shown in FIG. 16, the clamping members 68 and 69 are swung away from each other, and the clamping force imparted by the cathode-engaging pawls 75 and 76 is released.

Each of the cathodes 4 is clamped by one pair of the clamping units 62*a*, 62*c* or 62*b*, 62*d*. In order that the adjacent cathode clamping units may not interfere with each other, the cathode clamping units 62*a*, 62*b*, and 62*c*, 62*d* are displaced from each other by a distance *m* in the widthwise direction of the electrode carrier 30 as seen in FIGS. 14, 15 and 16. The anodes 3 and cathodes 4 in each electrolytic cell 1 are relatively closely arranged in such a relation that the cathode clamping members 68 and 69 may contact the anodes 3 when they are swung to clamp the cathodes 4. However, due to the fact that each of the anodes 3 is provided with the cutout 13 as described with reference to FIGS. 1 and 2, the cathode-engaging ends of the clamping members 68 and 69 do not contact the anodes 3 during the clamping action by virtue of the provision of the cutout 13 which permits free clamping movement of the clamping members 68 and 69.

The process for placing fresh anodes 3 and cathodes 4 into an empty electrolytic cell 1 for the purpose of electrolytic refining of lead comprises arranging the fresh anodes 3 and cathodes 4 on an electrode aligning device in the same pattern as that practically employed in the operating electrolytic cells 1, moving the electrode handling device 18 to the predetermined position above the electrode aligning device and lowering the electrode carrier 30 to the predetermined position dictated by the program of sequence control, actuating the anode and cathode clamping means to clamp the fresh anodes 3 and cathodes 4, raising the electrode carrier 30, moving the electrode handling device to the predetermined position directly above the specific empty electrolytic cell 1, lowering the electrode carrier 30 to the predetermined loading position, and releasing the clamping force to load the fresh anodes 3 and cathodes 4 in the empty electrolytic cell 1. The process performed after the electrolysis in the electrolytic cell 1 comprises moving the electrode handling device 18 to the predetermined position directly above the electrolytic cell 1, clamping the electrodes by the clamping means of the electrode carrier 30, raising the electrode carrier 30, moving the electrode handling device 18 to the predetermined unloading position, lowering the electrode carrier 30, and unloading the electrodes by releasing the clamping force. These steps are successively repeated for the placement and replacement of the electrodes in the electrolytic cells 1. In the case of unloading of the electrodes from the electrolytic cells 1, the anodes and cathodes may be separately handled.

It will be understood from the foregoing detailed description of the present invention that the anodes are provided with a pair of recesses to be engaged by clamping rods of a vertically movable electrode carrier mounted to an electrode handling device, and the anodes are further provided with a cutout which permits free clamping and clamp-releasing movement of cathode clamping members mounted to the electrode carrier for clamping the cathodes at opposite sides thereof. Therefore, the electrodes of large size can be collectively handled within the allowable range of the narrow space and can be automatically loaded into and unloaded from the electrolytic cells. Further, the electrodes can be automatically and economically handled according to a program of sequence control due to the fact that the positional relation between the rails for guiding the electrode handling device and the electrodes in the electrolytic cell is the same in each individual electrolytic cell.

We claim:

1. An apparatus for automatically replacing electrodes used for the electrolytic refining of metal comprising:

a group of electrolytic cells arranged in series and having a plurality of first electrodes and a plurality of second electrodes disposed alternately therein, each said electrode in said first electrode group being provided with a pair of horizontal recesses on opposite side edges of the upper end thereof and a central cutout formed between said recesses to terminate in a bottom level lower than the level of the upper end of the electrodes of said second electrode group disposed alternately with those of said first electrode group;

an electrode handling device adapted for travelling movement along rails laid in parallel on opposite sides of said electrolytic cell group;

an electrode carrier mounted in said electrode handling device for vertical movement;

a pair of parallel rods mounted to said electrode carrier to extend horizontally normal to the disposed direction of said electrodes, said rods being urged toward and away from each other thereby engaging said recesses of said electrodes in said first electrode group when urged toward each other; and a plurality of clamping units mounted to said electrode carrier and adapted to freely make clamping movement in the space defined by said cutout of said electrodes in said second electrode group, thereby clamping said electrodes in said second electrode group at opposite sides of the upper central part thereof.

2. An apparatus as claimed in claim 1, further comprising:

a pair of drive shafts mounted in horizontally parallel relation to the lower part of said electrode carrier;

a plurality of pairs of follower links fixed at one end thereof to said drive shafts respectively for supporting said parallel rods respectively at the other end thereof; and a pair of driving links fixed at one end thereof to said drive shafts respectively and operatively connected at the other end thereof to a pair of hydraulic cylinders respectively mounted to said electrode carrier;

whereby said parallel rods engage the recesses of said electrodes in said second electrode group when said parallel rods are urged toward each other by being actuated by said hydraulic cylinders.

3. An apparatus as claimed in claim 1, wherein each said clamping unit comprises a pair of clamping members adapted for clamping each said electrode in said second electrode group at opposite sides of the upper end, a rod operatively connected to a hydraulic cylinder provided in common to all said clamping units for causing swinging movement of said clamping members toward and away from each other, and a link mechanism operatively connecting said rod to said clamping members, said clamping units being displaced from each other in the widthwise direction of said electrode carrier so that said clamping members in each said clamping unit may not interfere with those in the adjacent ones during the swinging movement.

4. An apparatus as claimed in claim 1, further comprising:

guide means provided on said electrode handling device for accurately guiding the vertical movement of said electrode carrier;

a rack disposed along one of said rails;

a pinion mounted to said electrode handling device and making meshing engagement with said rack for driving said electrode handling device along said rails;

position detection means provided on one of support blocks for said rails at a position corresponding to each said electrolytic cell; and an approximate switch cooperating with said position detection means for stopping the travelling movement of said electrode handling device along said rails, said approximate switch being supported by a member of material which is not ferromagnetic.

5. An apparatus for automatically replacing electrodes used for the electrolytic refining of metal comprising:

a plurality of parallel electrolytic cell groups each consisting of a plurality of electrolytic cells arranged in series and having a plurality of first electrodes and a plurality of second electrodes disposed alternately therein; each said electrode in said first electrode group being provided with a pair of horizontal recesses on opposite side edges of the upper end thereof and a central cutout formed between said recesses to terminate in a bottom level lower than the level of the upper end of the electrodes of said second electrode group disposed alternately with those of said first electrode group;

an electrode handling device adapted for travelling movement along rails laid in parallel on opposite sides of each said electrolytic cell group;

a traversing truck adapted for travelling movement along rails laid normal to the longitudinal direction of said electrolytic cell groups, said truck moving in the transverse direction while carrying said electrode handling device thereon for transferring said electrode handling device from the position located above one of said electrolytic cell groups to another;

an electrode carrier mounted to said electrode handling device for vertical movement;

a pair of parallel rods mounted to said electrode carrier to extend horizontally normal to the disposed direction of said electrolytic cells, said rods being urged toward and away from each other thereby engaging said recesses of said electrodes in said first electrode group when urged toward each other; and a plurality of clamping units mounted to said electrode carrier and adapted to freely make clamping movement in the space defined by said cutout of said electrodes in said first electrode group, thereby clamping said electrodes in said first electrode group at opposite sides of the upper central part thereof.

6. An apparatus as claimed in claim 5, further comprising:

a pair of drive shafts mounted in horizontally parallel relation to the lower part of said electrode carrier;

a plurality of pairs of follower links fixed at one end thereof to said drive shafts respectively for suporting said parallel rods respectively at the other end thereof; and a pair fo driving links fixed at one end thereof to said drive shafts respectively and operatively connected at the other end thereof to a pair of hydraulic cylinders respectively mounted to said electrode carrier;

whereby said parallel rods engage the recesses of said electrodes in said first electrode group when said parallel rods are urged toward each other by being actuated by said hydraulic cylinders.

7. An apparatus as claimed in claim 5, wherein each said clamping unit comprises a pair of clamping members for clamping each said electrode in said second electrode group at opposite sides of the upper end, a rod operatively connected to a hydraulic cylinder provided in common to all said clamping units for causing swinging movement of said clamping members toward and away from each other, and a link mechanism operatively connecting said rod to said clamping members, said clamping units being displaced from each other in the widthwise direction of said electrode carrier so that said clamping members in each said clamping unit may not interfere with those in the adjacent ones during the swinging movement.

8. An apparatus as claimed in claim 5, further comprising guide means provided on said electrode handling device for accurately guiding the vertical movement of said electrode carrier;

a rack disposed along each of said rails;

a pinion mounted to said electrode handling device and making meshing engagement with a desired one of said racks for driving said electrode handling device along said rails;

position detection means provided on each of support blocks for said rails at a position corresponding to each said electrolytic cell; and an approximate switch cooperating with said position detection means for stopping the travelling movement of said electrode handling device along said rails, said approximate switch being supported by a member of material which is not ferromagnetic.

* * * * *